US007415925B2

(12) United States Patent
Fox

(10) Patent No.: US 7,415,925 B2
(45) Date of Patent: Aug. 26, 2008

(54) TRASH COMPACTOR CABINET CONSTRUCTION

(75) Inventor: Anthony Fox, Minneapolis, MN (US)

(73) Assignee: Buhl Hardwick, LLC, Maple Grove, MN (US)

( * ) Notice: Subject to any disclaimer, the term of this patent is extended or adjusted under 35 U.S.C. 154(b) by 64 days.

(21) Appl. No.: 11/505,774

(22) Filed: Aug. 17, 2006

(65) Prior Publication Data

US 2008/0041246 A1 Feb. 21, 2008

(51) Int. Cl.
*B30B 15/06* (2006.01)

(52) U.S. Cl. ..... 100/233; 100/48; 100/99; 100/215; 100/219; 100/226; 100/345

(58) Field of Classification Search ..... 100/48, 100/49, 52, 99, 215, 219, 226, 229 A, 233, 100/262, 266, 295, 288, 345, 269.17; 220/908
See application file for complete search history.

(56) References Cited

U.S. PATENT DOCUMENTS 4,130,054 A * 12/1978 Tashman ..... 100/52
4,548,132 A * 10/1985 Moon ..... 100/52
4,552,061 A * 11/1985 Brutsman ..... 100/343
5,517,907 A * 5/1996 Fox ..... 100/349
5,713,270 A * 2/1998 Fitzgerald et al. ..... 100/49
6,925,928 B2 8/2005 Fox

* cited by examiner

*Primary Examiner*—Jimmy T Nguyen
(74) *Attorney, Agent, or Firm*—James J. Paige; Nikolai & Mersereau, P.A.

(57) ABSTRACT

A refuse compactor especially designed for use in fast-food restaurant environments includes a hydraulic pump driven by an electric motor for actuating a hydraulic ram to compress restaurant waste materials. The compactor includes a unique outer support structure that derives strength from the outer housing skins to support a compaction plate assembly. The compaction plate assembly maintains the platen inclined at a predetermined angle to the vertical when the platen is elevated and which forces the platen to a horizontal disposition during a downward compaction stroke. A motor operated closure member selectively blocks and unblocks a refuse-receiving opening formed in a front door of the compactor unit and with a motion detector controlling the opening and closing of the refuse entry door panel.

14 Claims, 6 Drawing Sheets

TRASH COMPACTOR CABINET CONSTRUCTION

BACKGROUND OF THE INVENTION

I. Field of the Invention

This invention relates generally to equipment for compacting waste material, and more particularly to the design of a trash compactor for use in fast food restaurants and other food vending establishments where the patron is expected to deposit his/her waste paper products in a trash receptacle upon leaving the establishment.

II. Discussion of the Prior Art

Many fast food restaurants and cafeterias typically provide a refuse or waste container near the exit doors of the establishment and at other convenient locations so that at the conclusion of a meal, the patron's tray containing napkins, paper cups, food wrappers, placemats, etc. can be dumped into the waste receptacle by the patron rather than by restaurant staff. However, it is up to the restaurant staff to periodically empty these trash receptacles, bag the waste materials in polyethylene bags, and then deposit the bagged waste in a dumpster for pick-up by a refuse removal service.

Because the waste material is merely allowed to fall by gravity in the conventional waste receptacles currently used, it is not particularly dense and frequent emptying of the waste receptacles by staff personnel is required to prevent overflow and attendant lack of patron compliance. The need to frequently empty the refuse receptacles can be a significant cost item for a restaurant operation. Moreover, since refuse haulers generally charge by volume and not by weight, bagged, loosely-compacted refuse takes up an inordinate amount of space in a dumpster and also adds to the cost of refuse disposal.

Trash compactors intended to meet these needs have been designed to effectively reduce this problem. One such compactor is fully described in my earlier U.S. Pat. No. 6,925,928 which is hereby incorporated by reference. However, those trash compactor designs typically utilize an internal support structure formed from steel I-beams or rectangular tubing that is independent of sheet metal or plastic panels comprising the outer housing or "skins" of the trash compactor. It would be beneficial if such an independent supporting structure were not necessary to provide the rigidity and strength for the hydraulic ram based compaction processes utilized in the prior art trash compactor designs. Eliminating support structures within the compactor would be greatly beneficial in terms of space savings and manufacturing costs.

A need, therefore, exists for an improved and more efficiently designed refuse compactor capable of compressing fast food restaurant trash so that less frequent emptying is required and a greater mass of waste material can be contained in a smaller volume. The present invention provides a unique solution to this problem.

SUMMARY OF THE INVENTION

In accordance with the present invention, there is provided a refuse compactor especially designed for use in a restaurant facility that comprises a structurally supportive housing frame having a horizontal, rectangular base and four upwardly extending sheet metal cabinet panels referred to herein as "skins" affixed to the base around its four perimeter edges. Extending across the width dimension of the compactor between its side wall proximate the top thereof is a horizontal tray member. Supported on the tray member is a hydraulic ram along with an electric motor and a hydraulic pump used to drive a hydraulic ram. A compaction plate assembly that includes a one-piece platen pivotally affixed to a support member for rotation about a horizontal axis, is coupled to the piston rod of the hydraulic ram. The piston rod is joined to the support member for driving the compaction plate in a vertical direction toward and away from the base. A pair of guide rods extends through sleeve bearings mounted on the tray member for maintaining alignment of the compaction plate assembly during its operational stroke. A biasing spring is disposed between the support member and the compaction plate for urging the platen from a first position that is inclined to the vertical, to a second horizontal position during a downward movement of the compaction plate assembly when the hydraulic ram is actuated. On a return stroke of the compaction plate assembly, the platen is returned to its inclined position.

Extending between the refuse compactor's sidewalls and mounted on the base is a front panel that includes a door which can be opened about a vertical hinge to withdraw a wheeled cart containing compacted trash. Located above this door is a refuse receiving opening. Mounted relative to the opening is a hinged panel that is pivotable about a horizontal axis for selectively blocking the refuse-receiving opening. In that the compaction plate is inclined to the vertical when in its raised disposition, it does not interfere with the opening of the hinged panel by a patron wishing to deposit refuse into the compactor. Means are provided for automatically swinging the hinged panel to its open position upon detection of the approach of a patron toward the compactor.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
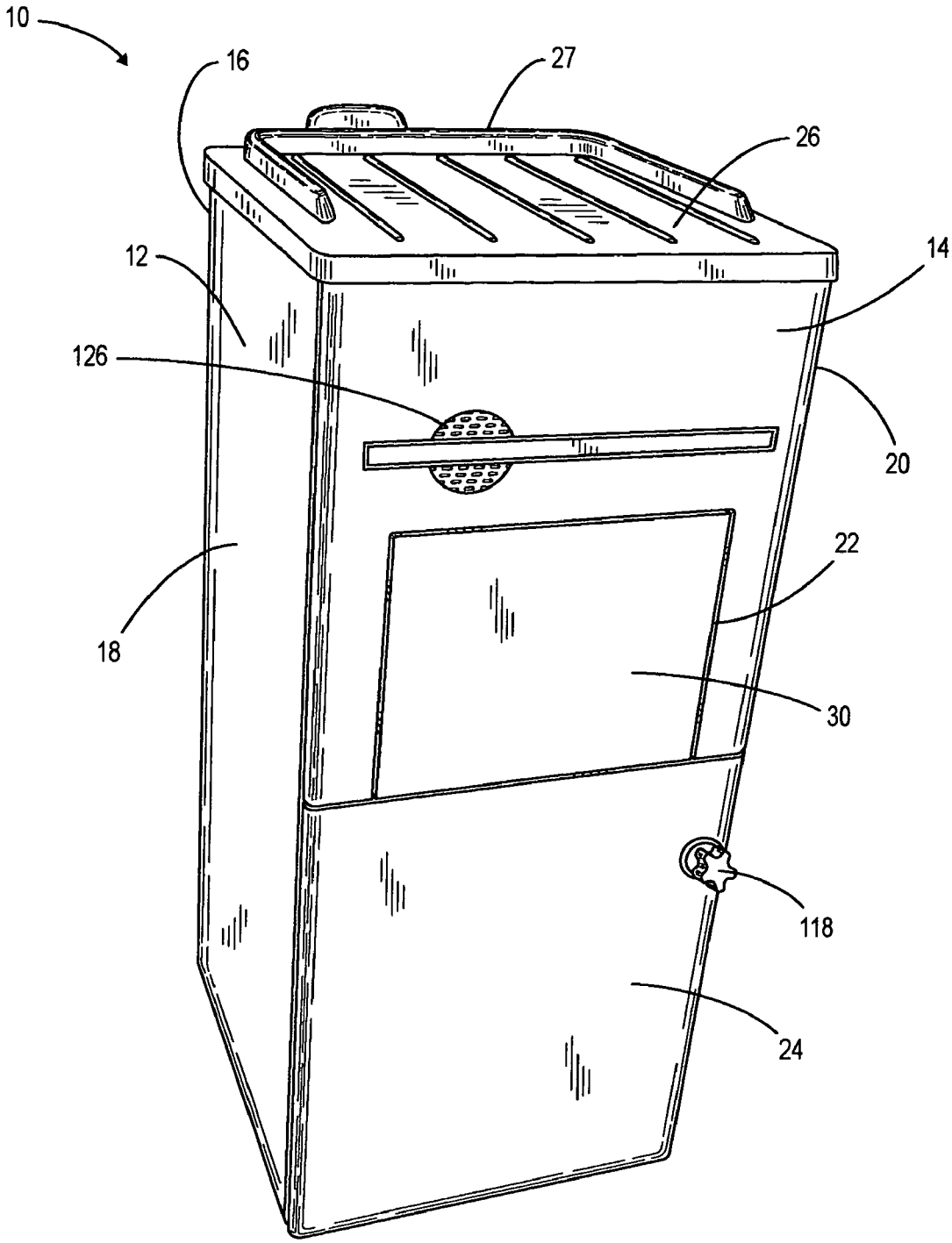
FIG. 1 is an isometric view of the trash compactor comprising a preferred embodiment of the present invention.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Shown in FIG. 1 is an isometric view of a trash compactor specifically designed for use in fast food restaurants. It is indicated generally by number 10. In this figure, the compactor cabinet 12 comprises an enclosure having four mutually perpendicular sidewalls joined to one another. The four sidewalls include a front panel 14, a back panel 16, and two side panels 18 and 20. An opening 22 is found in the top half of the front metal skin panel 14. Restaurant waste or the like can be deposited through this opening 22. As in my earlier '928 patent, the compactor is designed such that deposited waste falls into a polyethylene refuse bag (not shown) used to line the box of a removable cart assembly when the lower door 24 of the front skin panel is closed and locked. A removable plastic top panel 26 is attached to the top of the device. The top panel has upwardly projecting ribs 27 adjacent the side and rear perimeters of the top panel. The space between these ribs provides a convenient place for serving trays to be stacked once the waste has been deposited into the cart 28 (See FIG. 2) through the opening 22.

During use, the door 24 will be closed and locked. The door is only open to remove the cart 28 once it is filled with compacted waste material. A motor-operated hinged panel 30 normally blocks the opening 22, but swings to an open position when a proximity sensor detects the approach of a patron. An audio message is also played. The manner in which this is accomplished will be explained in considerably more detail as the description of the preferred embodiment continues.

Figure 2:
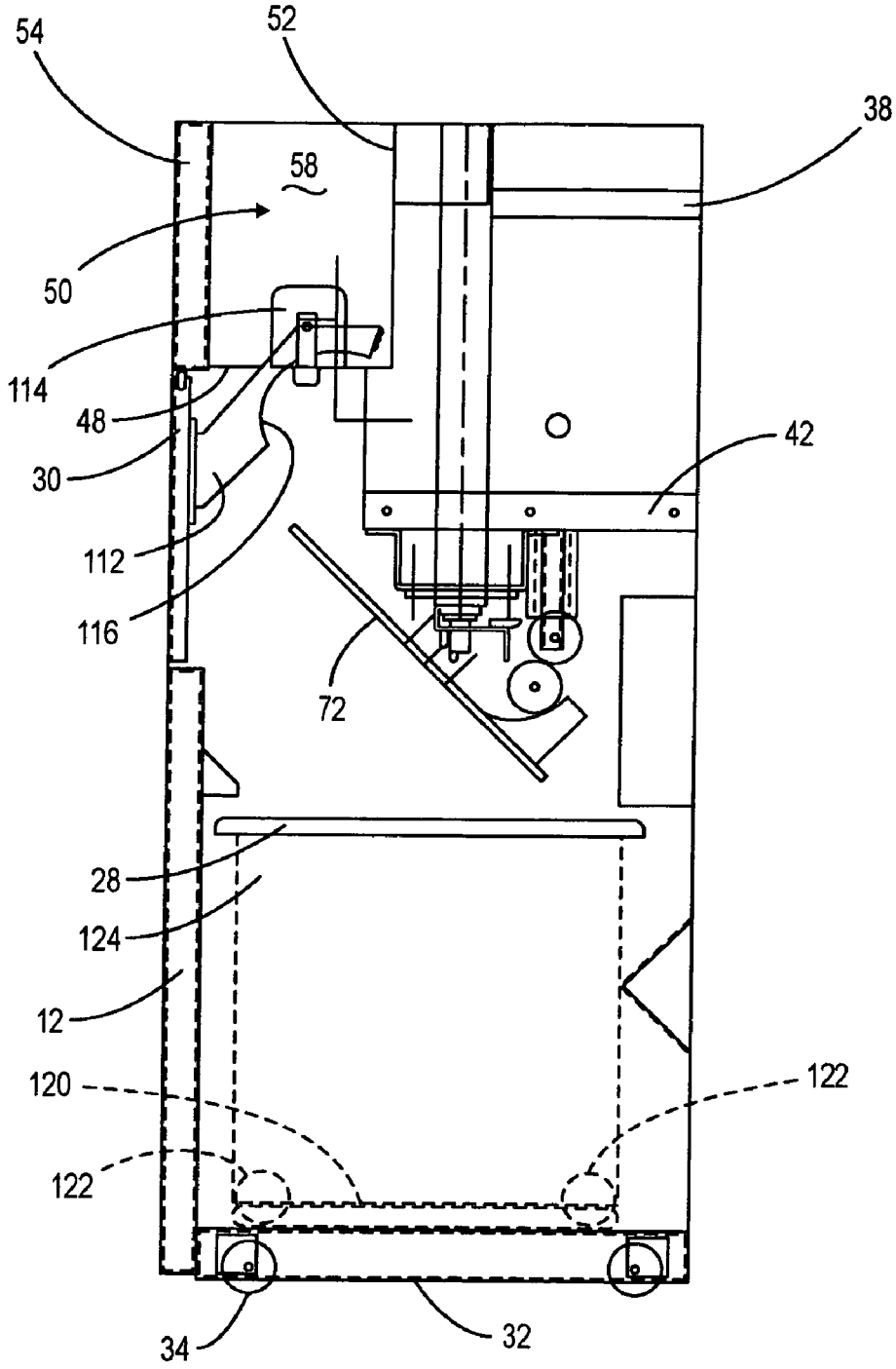
FIG. 2 is a cross-sectional right side view of the trash compactor of the present invention.

Referring then to FIG. 2, there is shown a cross-sectional right side view of the waste compactor 10 constructed in accordance with the present invention. The framework differs significantly from what is shown in my aforementioned '928 patent in that instead of utilizing heavy square tubes (labeled 18, 20, an 24 in the '928 patent), in the construction of the present invention the compactor force is resisted only by the sheet metal skins comprising side panels 18 and 20 (FIG. 1). The framework for the compactor includes a flat, generally rectangular steel base 32 that is mounted on four caster wheels, as at 34, to facilitate moving and positioning of the compactor. Extending between the upper ends of the side panels or vertical skins 18 and 20 is a steel plate 38 that spans the width of the opening between the metal skins found above the cabinet. The sides of that plate are bent perpendicular and are welded to the opposite side panels 18 and 20 comprising the sheet metal cabinet skins. The plate 38 conveniently supports electronic circuit boards comprising the compactor's controls.

Figure 3:
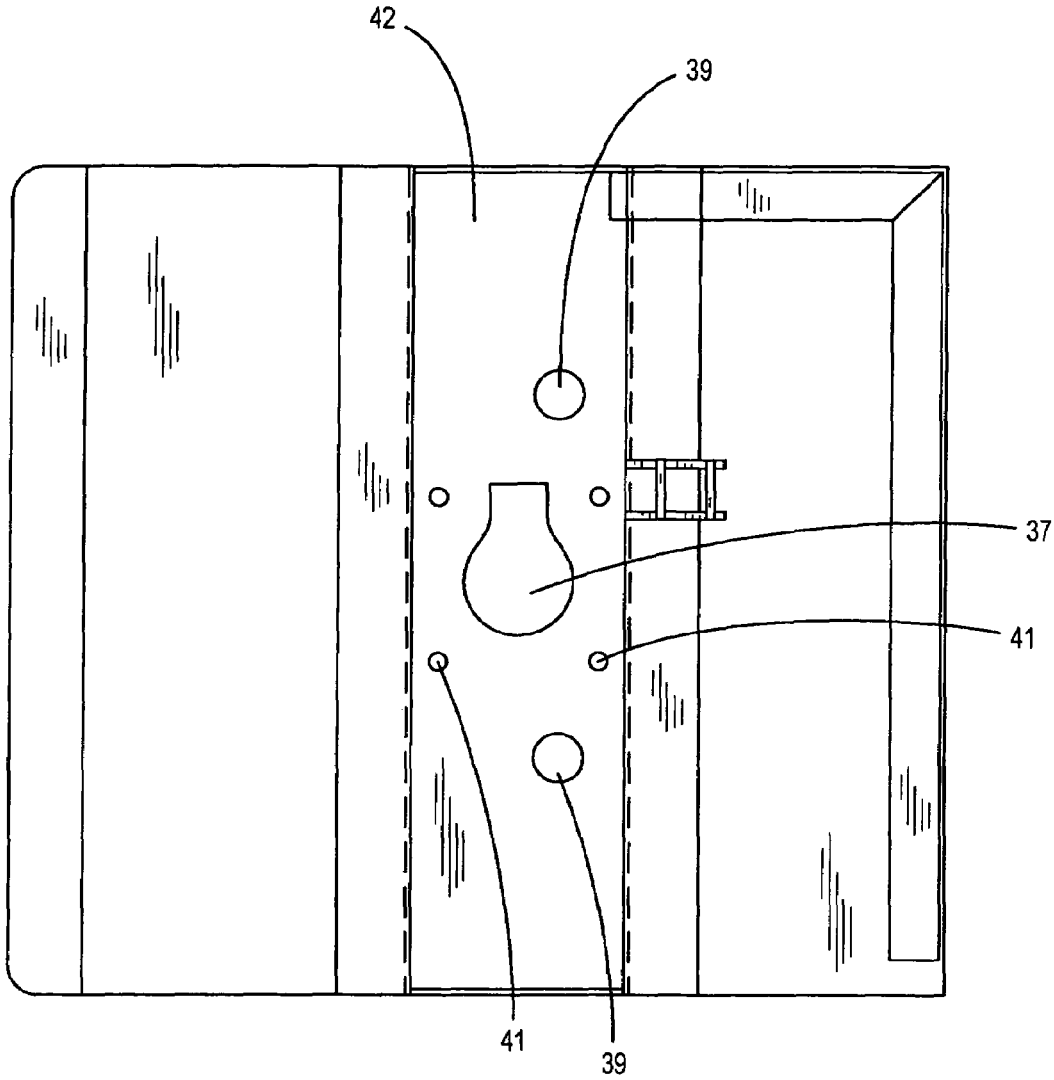
FIG. 3 is a top view of the present invention.

FIG. 3 shows a steel plate 42 spanning the width of cabinet 12. This component is also welded to the opposed side panels 18 and 20 about the steel plate's perimeter. There is a large key hole shaped aperture 37 in the center of the plate 42 through which the piston rod of the hydraulic ram 80 may extend when the cylinder thereof is bolted vertically in place with fasteners (not shown) that pass through the four apertures 41. Additionally found in plate 42 are a pair of holes 39 for accommodating passages of the guide rods 84. These holes 39 are disposed on either side of the keyhole shaped aperture 37. Extra rigidity and support is supplied by the steel plate 42.

Figure 4:
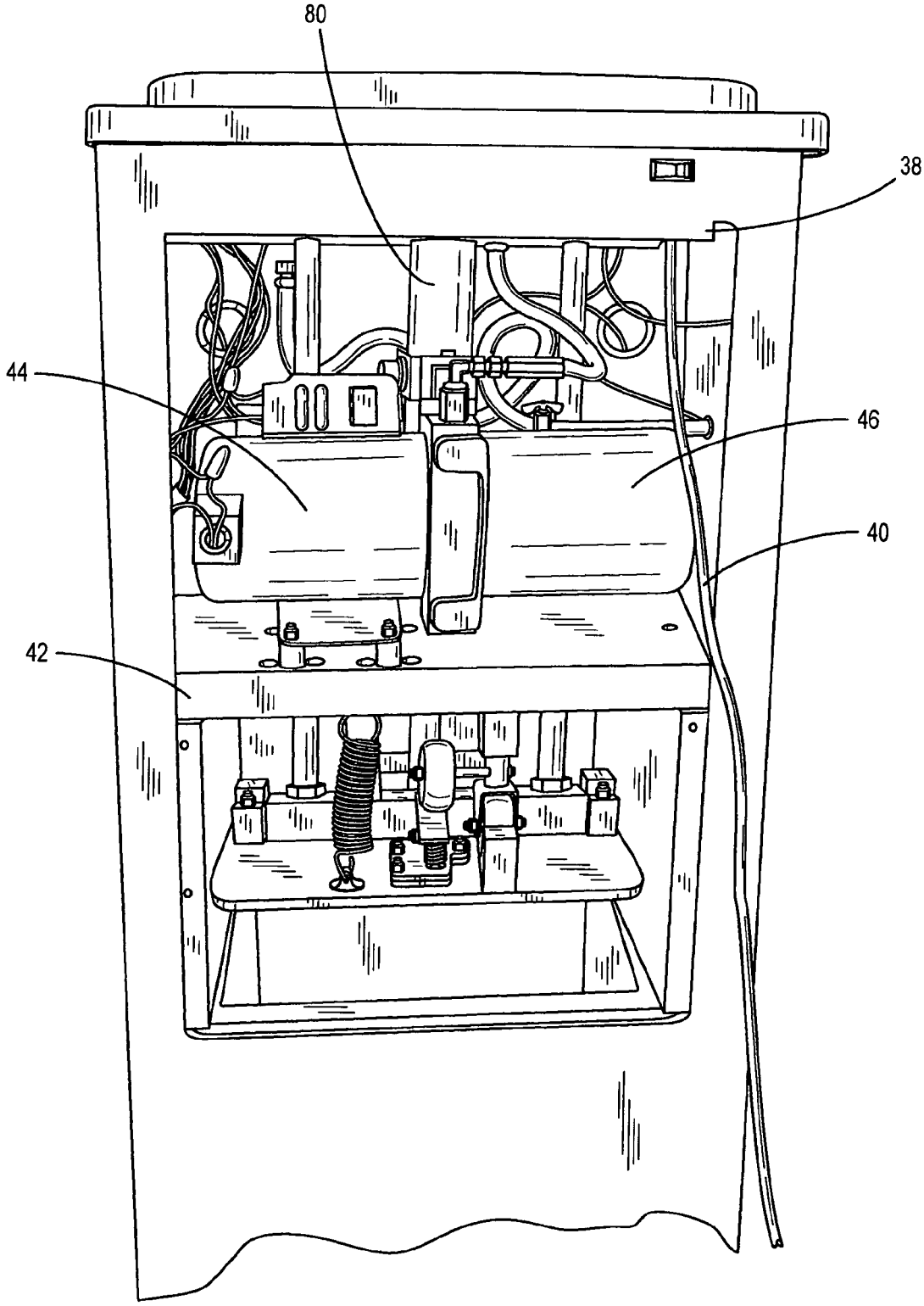
FIG. 4 is rear view of the invention, where the back panel is removed.

Referring now to FIG. 4, the back of the device is seen with a back cover panel removed so that the device's internal features can be readily viewed. First, located above the large upper opening in the back of the device, is the steel tray 38 welded to the edges of the wall skins, on which is supported an electronic control board assembly. (Not shown) Electrical power is delivered to the compactor 10 by way of a power cord 40 that is adapted to plug into a connector on the rear of the tray 38. Residing on the support plate 42 are an electric motor 44 that is coupled in driving relation to a hydraulic pump 46 for powering the ram 80.

Referring again to the frame assembly shown in FIG. 2, also welded to the vertical skins 12 at a location proximate the upper ends thereof, is a steel tray indicated generally by numeral 50. It has a vertical rear wall 52 welded at each side edge to the vertical skins 12 and a vertical front wall 54. To add additional rigidity to the steel tray 50, a steel partition plate 58 located approximately midway across the width dimension of the steel tray 50 is welded to the rear plate 52, the front plate 54 and the floor plate 48.

Figure 5:
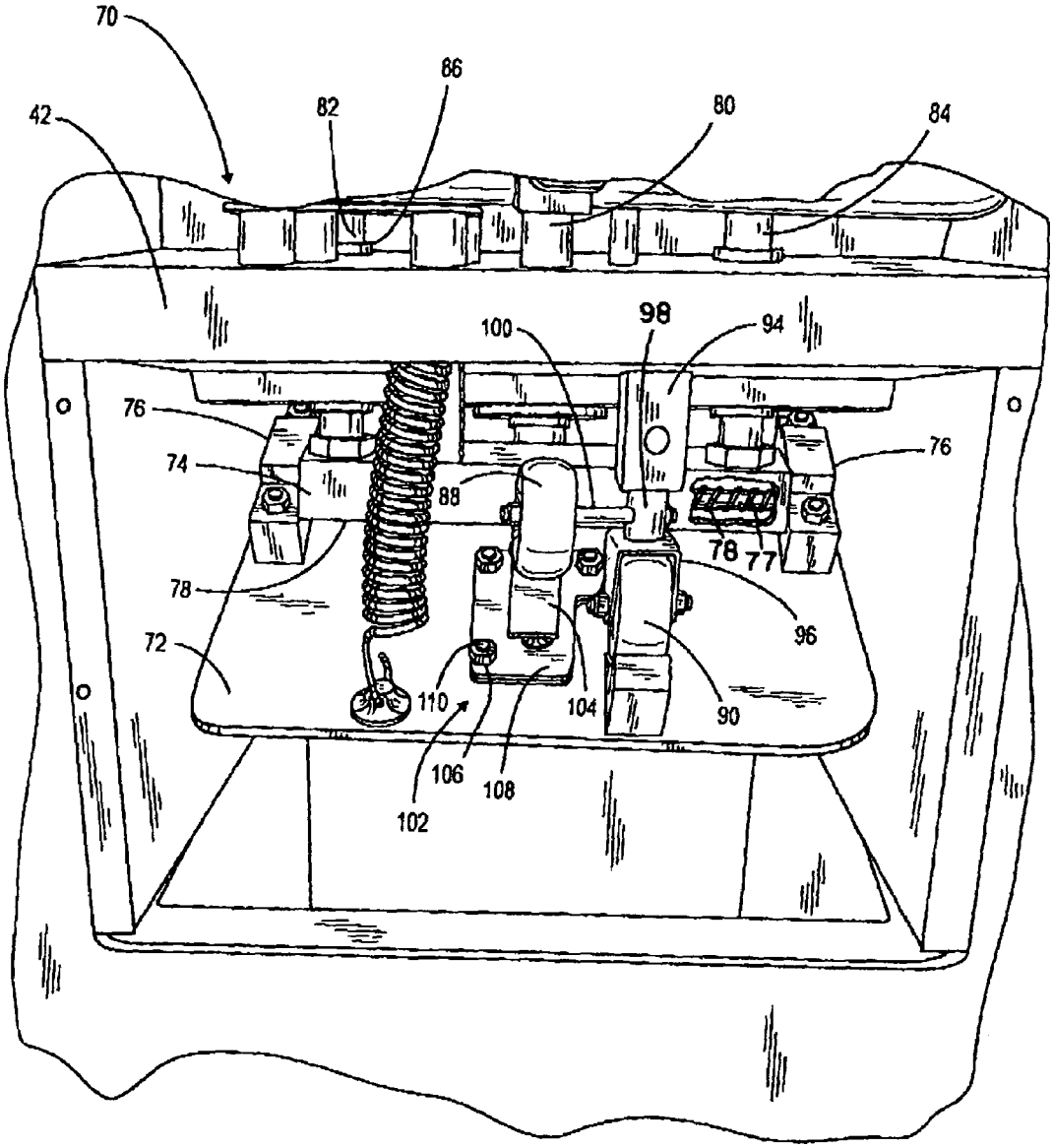
FIG. 5 is rear view of the invention, where the back panel is removed and the compaction plate is in the open position.

Referring momentarily to FIG. 5, there is indicated generally by numeral 70 a compaction plate assembly. It includes a cast aluminum plate or platen 72 that is pivotally mounted to a steel channel support member 74. The pivot connection includes a pair of compactor plate bearings 76, disposed midway along the side edges of the compaction plate 72, through which a cylindrical hinge rod 77 extends to allow rotation of the platen 72 about a horizontal axis. A pair of strong, helical springs 78 is mounted on the pivot pin. They are operatively disposed between the channel support member 74 and the compaction plate 72 so as to apply a biasing force thereto tending to rotate the compaction plate 72 so that it becomes parallel to the top surface of the channel support member 74, i.e., horizontal, during a compaction stroke, all as will be further described.

With continued reference to the compaction plate assembly 70 of FIG. 5, affixed to the top surface of the channel support member 42 is the hydraulic ram 80. It is centrally disposed between a pair of guide rods 82 and 84. Guide sleeves, as at 86, fit into openings formed through the support plate 42 from which the compaction plate assembly 70 is suspended and serve as bearings for the guide rods 82 and 84. The ram attaches to the steel plate 42 and is vertically oriented such that when pressurized by hydraulic fluid from the pump 46 causes the compaction plate to execute a compaction stroke whereby trash deposited in the cart 28 is crushed and compressed.

Figure 6:
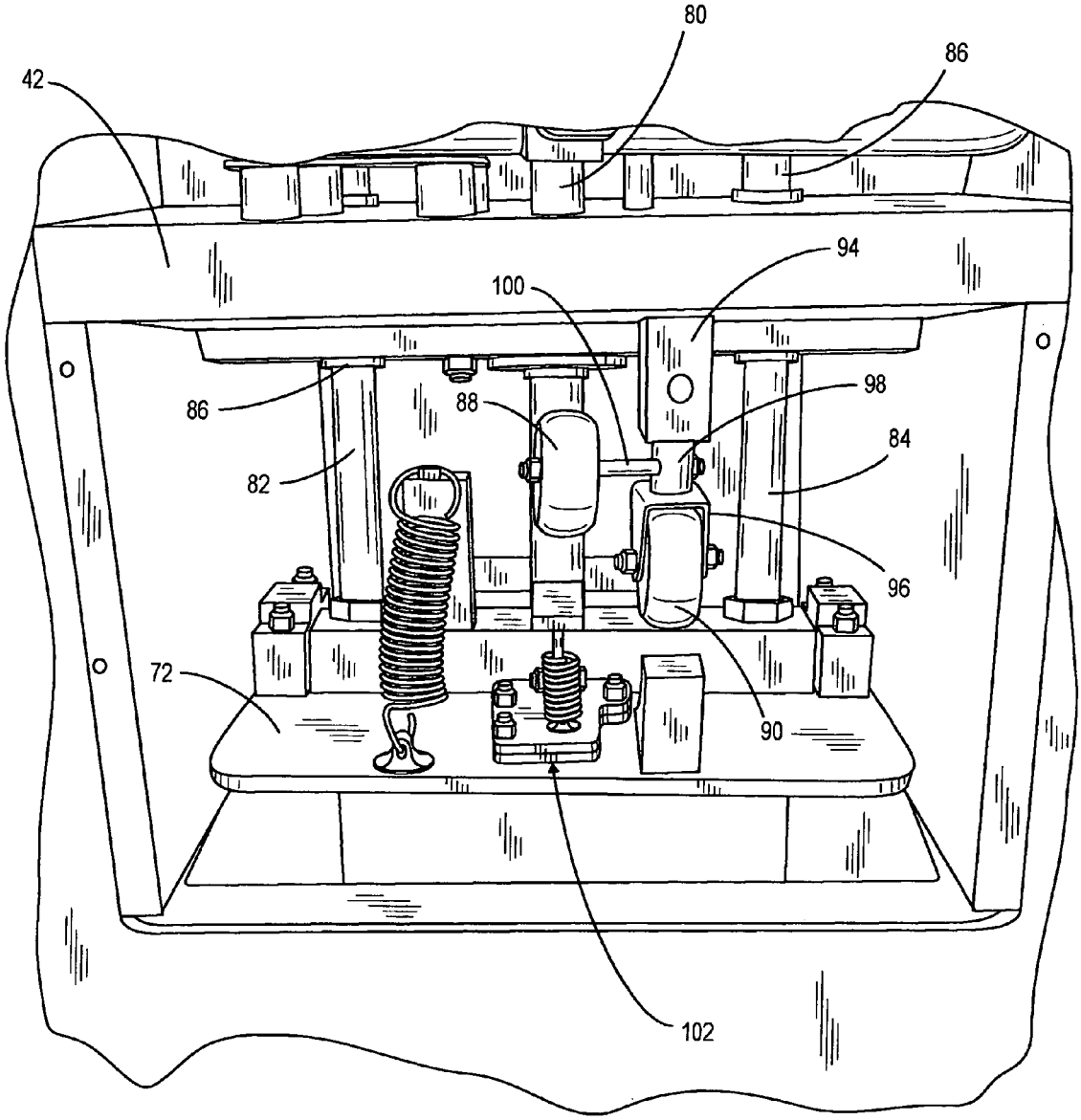
FIG. 6 is rear view of the invention, where the back panel is removed and the compaction plate is in the closed position.

As in my earlier '928 Patent, to avoid having trash deposited on the top surface of the compaction plate 72, it is imperative that the compaction plate be inclined as shown in FIG. 5 as waste is being deposited through the door opening 22. However, in order to effect compaction, the plate must assume a horizontal disposition during its downward compaction stroke (as seen in FIG. 6) and return to its inclined disposition at the end of the compaction stroke. To achieve this result, there is provided an assembly structure holding two non-axially aligned large diameter rollers 88 and 90 that are suspended from a tube 94 of rectangular cross section that is welded to the undersurface of the support plate 42. The roller 90 is journaled for rotation in a U-shaped bracket 96 having a rectangular tube 98 welded to it. Also protruding out the side of rectangular tube 98 is a rod 100, thereby providing an axis for rotation of roller 88. The rectangular tube 98 is dimensioned to telescopingly fit within the tubular bracket 94 and is held in place by setscrews whereby the degree of extension can be adjusted.

Also attached to the top surface of the compaction plate is a compactor plate latch assembly 102. It is used to releasably lock the platen in a horizontal position during the downward compaction stroke of the platen 72. As shown in FIG. 5, the compactor plate latch assembly comprises a rectangular base 108 pivotally supporting a rearwardly protruding, spring-loaded platform 104. Bolts, as at 110 extend through base 108 to permit attachment to the compaction plate 72. The platform assembly is set up such that as the compaction plate descends from the disposition shown in FIG. 5, the roller 88 will move out of contact with platform 104 and its spring will rotate the plate 104 so that a hook thereon will engage member 74 to latch the compaction plate. It will be latched in its horizontal disposition during the downward movement of the compaction plate assembly, assuring that any objects that may be in the trash being compacted cannot tilt the compaction plate away from its desired horizontal disposition.

During upward travel of the compaction plate, a point in the cycle is reached where the roller 88 again comes into contact with the latch plate 104 to disengage the latch from member 74 and, at this point, roller 90 riding on its cam surface 91 will cause the compaction plate to tilt against the force of spring 93.

Returning again to FIG. 2, the hinge panel 30 comprising the waste entry door is pivotally mounted to a pair of door hinge arms 112 which fasten by screws to the floor 48 of the steel tray 50. Fastened to the inside surface of the hinge panel 30 is a door motion arm that has an arcuate cam profile formed therein along its length dimension. Also mounted on the floor plate tray 48 is a door actuating motor 114 which is coupled through a gear box to one end of an arm supporting a cam follower roller on the free end thereof. The arm is joined to an output shaft of the gear box, as is a further cam (not shown). This further cam cooperates with Microswitches® which are connected in circuit with the motor 114 to cause the arm to be rotated 180° upon each actuation of the motor.

The roller is positioned to cooperate with the arcuate surface 116 on the arm 112 so as the arm moves through 180°, the waste entry door swings open to the position, allowing waste to be dumped into the cart 28. Because the platform of the compaction plate assembly is inclined, it does not interfere with the opening of the hinged panel waste entry door 30.

The actuation of the motor 114 is controlled by a commercially available motion sensor on the front panel 14, all as is further explained in my '928 patent. Thus, when the door 24 is closed and locked, as a patron approaches the waste compactor 10, the motion is detected and a signal is sent to the motor 114 to initiate a 180° swing of arm 112 to first open the waste entry door 30. As the patron moves away after depositing refuse into the compactor, the action is again sensed and the motor 114 is triggered to rotate the arm an additional 180°, allowing the waste entry door 30 to reclose.

A programmable logic array comprising the electronic circuit is configured to initiate a compaction cycle after a predetermined number of openings of the waste entry door 30. For example, and without limitation, the electronic circuit may be programmed such that ten patrons approaching and depositing refuse into the cart 28 will initiate a compaction cycle whereby that refuse is compressed into a cube defined by the side walls of the cart 28. To prevent the waste entry door 30 from opening during the compaction cycle, which might expose a patron to injury, an interlock is provided to block the waste entry door 30 from opening during a compaction cycle.

The door lock for securing the door 24 preferably comprises a bolt assembly 118 that is designed to pass through the door 24. The bolt 118 is sufficiently long to project through the thickness dimension of the door 24 and into a threaded block (not shown) within the device. Bolt 118 additionally has an enlarged plastic knob on the exterior of the front panel to enable easy opening and closing of the device.

The cart 28 includes a base tray 120 mounted on wheels 122 and supported on the base tray is a separable trash-receiving chamber 124. The chamber 124 has four mutually perpendicular sidewalls, an open top and an open bottom. For convenience, a polyethylene bag may be inserted into the chamber 124 for ultimately containing the trash once impacted. A pull handle may be pivotally attached to the base 120 to facilitate removing a filled and compacted mass of waste material through the open door 24 and to a temporary storage site. Once at the storage site, the tube-defining chamber 124 can be lifted free of the tray 120, leaving a compacted trash-filled bag for ultimate disposal by a trash hauling company.

It has also been found desirable to mount an audible speaker inside the front panel 14 where the speaker is coupled by wires to a voice chip integrated circuit on the electronics panel. Holes 126 are placed in the front panel 14 to aid those using the device in hearing this speaker. As in many telephone answering machines, these voice chips may be used to store several short audio messages that are played each time a patron causes the waste entry door 30 to swing open as a marketing tool. The messages may thank the patron for visiting the restaurant or for dumping his/her trash, etc.

It can be seen then that the trash compactor of the present invention provides all of the functionality of my earlier embodiment described in U.S. Pat. No. 6,925,928 while obviating the need for heavy I-beam or square tubing frame elements to withstand the forces applied to the waste during the compaction stroke.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A refuse compactor for a restaurant facility comprising:

(a) a structurally supportive cabinet comprising a horizontal rectangular base, four upwardly extending mutually perpendicular sheet metal panel members affixed to the base along perimeter edges thereof, and a horizontal top panel extending across the top of and joining the panel members at upper ends thereof, (b) a shelf extending across a width dimension of said cabinet and affixed to opposed ones of the panel members at a predetennined elevation above the base;

(c) a compaction plate assembly including a one-piece platen pivotally affixed to a support member for rotation about a horizontal axis, a compaction plate driver mounted on said shelf operatively coupled to said support member for driving the compaction plate in a vertical direction toward and away from said base; and (d) a cam block for pivoting the platen from a first position inclined to the vertical to a second horizontal position during a downward movement of the compaction plate assembly and returning the platen to the inclined position during an upward movement of the compaction plate assembly, (e) the cam block having an arcuate cam surface, the cam block being affixed to an upper surface of the compaction plate; a cam follower roller affixed to the shelf and positioned in a path of travel of the cam block; and a tension spring operatively coupled between the upper surface of the compaction plate and said shelf, said tension spring having one end connected to the upper surface of the compaction plate and an opposing end connected to the support member.

2. The refuse compactor as in claim 1 and further including a spring-loaded latch plate pivotally mounted to the upper surface of the compaction plate and disposed in operative position relative to a latch actuating roller whereby downward movement of the compaction plate actuates the spring-loaded latch plate to lock the compaction plate in its horizontal disposition and upward movement of the compaction plate and contact between the latch plate and the latch actuating roller releases the latch permitting the compaction plate to assume its inclined position.

3. The refuse compactor as in claim 1 and further including a refuse receiving opening in a front one of the upwardly extending panel members allowing for the deposit of waste material into the cabinet at a level below the platen when the platen is in the first position.

4. The refuse compactor as in claim 3 and further including a door in the front one of the upwardly extending panel members located below said opening, allowing for the insertion and removal of a waste cart.

5. The refuse compactor of claim 1 and further including a means for biasing the platen toward the second horizontal position.

6. The refuse compactor of claim 5 and further including a hinged panel pivotable about a horizontal axis for selectively blocking and unblocking the refuse-receiving opening.

7. The refuse compactor as in claim 6 and further including means for automatically pivoting the hinged panel to unblock the refuse-receiving opening.

8. The refuse compactor as in claim 6 and further including an electric motor operatively coupled to the hinged panel for pivoting the hinged panel to unblock the refuse receiving opening upon activation of the motor; and a motion sensor mounted on the door for initiating activation of the motor upon approach of a patron of the restaurant facility within a predetermined distance of the refuse compactor.

9. The refuse compactor as in claim 6 wherein said means for automatically pivoting the hinged panel places the hinged panel generally parallel to the platen when the platen is in the first position.

10. The refuse compactor as in claim 7 and further including means for preventing movement of the hinged panel from an opening blocking position during movement of the compaction plate assembly.

11. The refuse compactor as in claim 5 and further including an electrical switch for preventing operation of the compaction plate driver when the door member is ajar.

12. The refuse compactor as in claim 1 wherein the compaction plate driver comprises a hydraulic ram having a cylinder oriented vertically and attached to said shelf and a piston rod extending through a first aperture formed through the shelf and connected to said support member.

13. The refuse compactor as in claim 12 and further including a pair of guide rods attached at one end of each to said support member and extending upward therefrom; second and third apertures formed through the shelf on opposite sides of the first aperture, sleeve bearings disposed in the second and third apertures; and said pair of guide rods extending individually through the sleeve bearings.

14. The refuse compactor as in claim 1, wherein the shelf is welded to the opposed ones of the panel members.

* * * * *